United States Patent [19]

Clark

[11] Patent Number: 4,698,870

[45] Date of Patent: Oct. 13, 1987

[54] MULTI-SIZE GROUT STRIKING TOOL

[76] Inventor: Ronald M. Clark, 105 Factory, Addison, Ill. 60101

[21] Appl. No.: 869,231

[22] Filed: Jun. 2, 1986

[51] Int. Cl.[4] ..... E04G 21/20

[52] U.S. Cl. ..... 15/105.5; 15/235.3; 425/458

[58] Field of Search ..... 15/105, 105.5, 235.3, 15/236 R, 245; 425/458; 81/488; 52/749; 7/105

[56] References Cited

U.S. PATENT DOCUMENTS

| | | | |
|---|---|---|---|
| 1,509,457 | 9/1924 | Wickham | 15/105.5 X |
| 2,380,855 | 7/1945 | Lower | 15/236 R |
| 3,256,548 | 6/1966 | Peterson | 15/236 R |
| 3,351,969 | 11/1967 | Cline | 15/245 |

*Primary Examiner*—Edward L. Roberts

*Attorney, Agent, or Firm*—Robert F. Van Epps

[57] ABSTRACT

A plurality of circular grout striking projections each having a radius different than the rest are arranged about the periphery of a central circular disc such that no projection interferes with the use of any adjacent projection in striking grout between pieces of tile.

4 Claims, 1 Drawing Figure

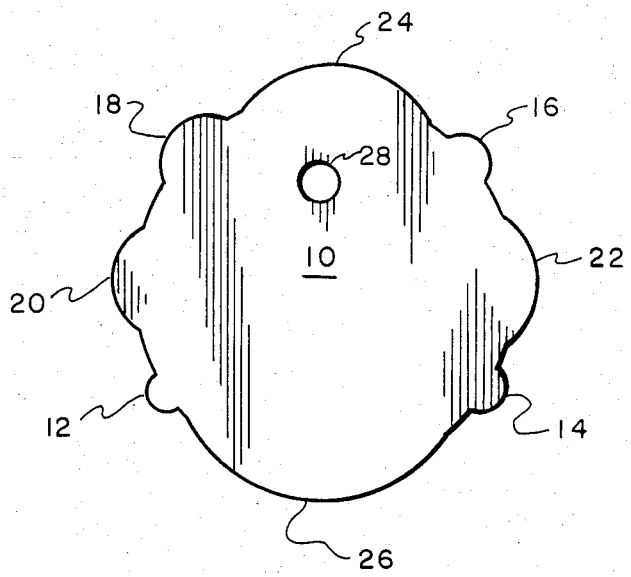
24
18
16
28
10
22
20
12
14
26

MULTI-SIZE GROUT STRIKING TOOL

BACKGROUND OF THE INVENTION

1. Field of the Invention

The present invention relates generally to the field of tile working tools and more particularly to an improved grout-striking tool useful with a variety of tile designs and spacing.

2. Description of the Prior Art

Prior to the present invention two types of grout striking tools were known to the applicant. The first is the generally S-shaped mortar striking tool commonly used in masonry applications. Each end of that tool is rounded to a different radius to accomodate two different mortar widths. The other tool is a single size plastic grout finisher which is essentially a plastic thimble and commercially available from Plasplugs, Inc. of Eatontown, N.J.

Ceramic tile in present use on walls and floors comes in a wide variety of designs; e.g. rounded, beveled or square edges, irregular shapes and spacing between adjacent tiles which can vary generally over the range of from one-sixteenth to one-half inch. Depending upon the final appearance desired it is clear that the grout striking tools of the prior art are not sufficiently versatile to accomodate the wide variety of tile applications.

OBJECTS AND SUMMARY OF THE INVENTION

From the preceding discussion it will be understood that among the objectives of the present invention are included the following:

the provision of a new and improved grout striking tool;

the provision of a tool of the above-described character which is useful in a wide variety of tile applications; and the provision of a tool of the above-described character which is simple and economical to manufacture.

These and other objectives of the present invention are efficiently achieved by providing a plurality of circular grout striking projections each having a radius different than the others about the periphery of a central circular disc. Each projection is useful for a different tile application and is arranged with respect to the others such as not to interfere with the use of any adjacent projection in striking grout betwen pieces of tile.

The foregoing as well as other objects features and advantages of the present invention will become more apparent from the following detailed description taken in conjunction with the appended drawing.

BRIEF DESCRIPTION OF THE DRAWING

The single appended drawing is a plan view of a multi-size grout striking tool in accordance with the principles of the present invention.

DESCRIPTION OF THE PREFERRED EMBODIMENT

With reference now to the drawing there is shown a circular disc 10 having a plurality of circular projections 12–26 integrally formed with the disc 10 and arranged about the periphery thereof. The radius of each projection 12–26 is different from each other projection. By way of example and not in limitation the projections could be as follows:

| Projection | Radius |
|---|---|
| 12 | ¼" |
| 14 | 5/16" |
| 16 | ⅜" |
| 18 | ⅝" |
| 20 | ¾" |
| 22 | 1" |
| 24 | 1½" |
| 26 | 2" |

The arrangement of the projections 12–26 with respect to one another is such that any given one will not interfere with the next adjacent one in use for striking grout in a given tile application.

The present invention is particularly well suited for economical manufacture either by injection molding of a thermoplastic material such as styrene or polypropylene or any thermoset material. Alternatively the tool may be formed by die cutting from wood, composite, metal or any other suitable material. For display and storage pruposes the tool may be provided with an aperture 28 therethrough.

From the foregoing it will be understood that the applicant has provided a simple and economical multi-size grout striking tool having the versatility to accomodate a wide variety of tile applications. Since certain changes in the above-described construction will occur to those skilled in the art without departure from the scope of the invention it is intended that all matter contained in the above description or shown in the appended drawing shall be interpreted as illustrative and not in a limiting sense.

Having described what is new and novel and desired to secure by Letters Patent, what is claimed is:

1. A grout striking hand tool comprising a substantially flat circular disc having integrally formed therewith a plurality of substantially circular grout striking projections distributed about the periphery thereof, each projection being of a radius different than the radii of all other said projections, and said projections being arranged with respect to one another such that no projection interferes with the striking of grout by any adjacent projection.

2. A grout striking hand tool as set forth in claim 1 wherein said disc and plurality of projections are integrally molded of a thermoplastic material.

3. A grout striking hand tool as set forth in claim 2 wherein said thermoplastic material is styrene.

4. A grout striking hand tool as set forth in claim 1 wherein said disc has an aperture therethrough.

* * * * *